US008480513B2

(12) United States Patent
Kuan et al.

(10) Patent No.: US 8,480,513 B2
(45) Date of Patent: Jul. 9, 2013

(54) PUTTER-TYPE GOLF CLUB HEAD

(75) Inventors: Jimmy H. Kuan, West Covina, CA (US); Michael D. Sandoval, La Palma, CA (US); Adam K. Sheldon, Long Beach, CA (US)

(73) Assignee: SRI Sports Limited, Kobe-shi (JP)

( * ) Notice: Subject to any disclaimer, the term of this patent is extended or adjusted under 35 U.S.C. 154(b) by 65 days.

(21) Appl. No.: 12/343,949

(22) Filed: Dec. 24, 2008

(65) Prior Publication Data

US 2010/0113184 A1 May 6, 2010

Related U.S. Application Data

(63) Continuation-in-part of application No. 12/265,478, filed on Nov. 5, 2008.

(51) Int. Cl.
*A63B 53/04* (2006.01)

(52) U.S. Cl.
USPC ..... 473/329; 473/340

(58) Field of Classification Search
USPC ..... 473/324–350
See application file for complete search history.

(56) References Cited

U.S. PATENT DOCUMENTS

| | | | | |
|---|---|---|---|---|
| 922,444 | A | 5/1909 | Youds | |
| 3,043,596 | A * | 7/1962 | Ehmke | 473/240 |
| 3,134,596 | A * | 5/1964 | Boznos | 473/250 |
| 3,866,922 | A | 2/1975 | Marci et al. | |
| 3,873,094 | A * | 3/1975 | Sebo et al. | 473/250 |
| 4,222,566 | A * | 9/1980 | Berry | 473/250 |
| 4,324,404 | A * | 4/1982 | Dian | 473/340 |
| 4,573,685 | A * | 3/1986 | Young et al. | 473/250 |
| 4,679,792 | A | 7/1987 | Straza et al. | |
| 4,681,322 | A | 7/1987 | Straza et al. | |
| 4,801,146 | A | 1/1989 | Honma | |
| 5,190,290 | A | 3/1993 | Take | |
| 5,332,214 | A | 7/1994 | Tucker, Sr. | |
| 5,332,223 | A * | 7/1994 | Johnson | 473/306 |
| 5,358,249 | A | 10/1994 | Mendralla | |
| 5,425,535 | A | 6/1995 | Gee | |
| 5,460,377 | A * | 10/1995 | Schmidt et al. | 473/328 |
| 5,485,997 | A * | 1/1996 | Schmidt et al. | 473/251 |
| 5,529,543 | A | 6/1996 | Beaumont, Sr. | |
| 5,542,675 | A | 8/1996 | Micciche et al. | |

(Continued)

FOREIGN PATENT DOCUMENTS

| | | |
|---|---|---|
| GB | 2 185 891 A | 8/1987 |
| JP | A-51-082554 | 7/1976 |

(Continued)

OTHER PUBLICATIONS

"Polyurethane" Efunda Enginnering Fundamentals, www.efunda.com, copyright 2002.*

(Continued)

*Primary Examiner* — Alvin Hunter
(74) *Attorney, Agent, or Firm* — Oliff & Berridge, PLC

(57) ABSTRACT

A golf club head according to one or more aspects of the present invention may include a body comprising a front surface, having an opening therein for receiving a primary insert. One or more secondary inserts may be disposed in the primary insert and may include a leading surface and a trailing surface. The trailing surface may be physically exposed to the elements and the leading surface may be physically exposed and/or visually exposed.

16 Claims, 13 Drawing Sheets

U.S. PATENT DOCUMENTS

| | | | | | |
|---|---|---|---|---|---|
| 5,575,472 | A | | 11/1996 | Magerman et al. | |
| 5,605,510 | A | * | 2/1997 | Schmidt et al. | 473/251 |
| 5,643,103 | A | | 7/1997 | Aizawa | |
| 5,690,562 | A | | 11/1997 | Sturm | |
| 5,735,755 | A | | 4/1998 | Kobayashi | |
| 5,766,093 | A | * | 6/1998 | Rohrer | 473/329 |
| 5,807,190 | A | * | 9/1998 | Krumme et al. | 473/342 |
| 5,810,682 | A | * | 9/1998 | Carruthers | 473/528 |
| 5,816,930 | A | | 10/1998 | Brown | |
| 5,842,935 | A | * | 12/1998 | Nelson | 473/342 |
| 5,924,938 | A | | 7/1999 | Hines | |
| 5,924,939 | A | * | 7/1999 | Grace et al. | 473/324 |
| 5,944,619 | A | * | 8/1999 | Cameron | 473/332 |
| 5,964,669 | A | | 10/1999 | Bloomer | |
| 5,967,903 | A | * | 10/1999 | Cheng | 473/342 |
| 5,972,144 | A | * | 10/1999 | Hsu | 156/154 |
| 6,001,031 | A | * | 12/1999 | San Juan | 473/340 |
| 6,024,650 | A | | 2/2000 | Reeves | |
| 6,089,992 | A | | 7/2000 | Onuki et al. | |
| 6,089,993 | A | | 7/2000 | Woodward et al. | |
| 6,200,229 | B1 | * | 3/2001 | Grace et al. | 473/324 |
| 6,231,458 | B1 | * | 5/2001 | Cameron et al. | 473/332 |
| 6,244,972 | B1 | * | 6/2001 | Drossos | 473/224 |
| 6,270,423 | B1 | * | 8/2001 | Webb | 473/226 |
| 6,273,831 | B1 | | 8/2001 | Dewanjee | |
| 6,277,033 | B1 | * | 8/2001 | Krumme et al. | 473/342 |
| 6,302,807 | B1 | * | 10/2001 | Rohrer | 473/329 |
| 6,334,818 | B1 | * | 1/2002 | Cameron et al. | 473/332 |
| 6,406,379 | B1 | | 6/2002 | Christensen | |
| 6,425,831 | B1 | * | 7/2002 | Heene et al. | 473/332 |
| 6,443,857 | B1 | * | 9/2002 | Chuang | 473/332 |
| 6,450,894 | B1 | | 9/2002 | Sun et al. | |
| 6,475,101 | B2 | | 11/2002 | Burrows | |
| 6,488,594 | B1 | | 12/2002 | Card et al. | |
| 6,554,721 | B1 | | 4/2003 | Woodward et al. | |
| 6,592,467 | B1 | | 7/2003 | Gray | |
| 6,683,152 | B2 | | 1/2004 | Wu et al. | |
| 6,688,989 | B2 | | 2/2004 | Best | |
| 6,699,140 | B1 | * | 3/2004 | Sun | 473/252 |
| 6,729,972 | B2 | * | 5/2004 | Boord | 473/340 |
| 6,849,004 | B2 | * | 2/2005 | Lindsay | 473/330 |
| 6,951,518 | B2 | * | 10/2005 | Solheim et al. | 473/324 |
| 7,018,305 | B2 | | 3/2006 | Sugimoto | |
| 7,083,525 | B2 | | 8/2006 | Pond et al. | |
| 7,086,961 | B2 | * | 8/2006 | Wright et al. | 473/329 |
| 7,108,613 | B1 | * | 9/2006 | Gordon et al. | 473/341 |
| 7,112,147 | B2 | | 9/2006 | Solheim et al. | |
| 7,144,335 | B2 | * | 12/2006 | Breier et al. | 473/340 |
| D548,299 | S | | 8/2007 | Nguyen et al. | |
| 7,261,644 | B2 | * | 8/2007 | Burrows | 473/340 |
| 7,273,420 | B2 | | 9/2007 | Wright | |
| 7,278,926 | B2 | | 10/2007 | Frame | |
| 7,309,291 | B1 | | 12/2007 | Bryant et al. | |
| D562,921 | S | | 2/2008 | Nguyen et al. | |
| 7,341,527 | B1 | | 3/2008 | Fisher | |
| D572,786 | S | | 7/2008 | Ban et al. | |
| 7,393,287 | B2 | * | 7/2008 | Huang | 473/329 |
| 7,396,295 | B1 | | 7/2008 | Frame et al. | |
| 7,407,443 | B2 | | 8/2008 | Franklin et al. | |
| 7,422,527 | B2 | | 9/2008 | Rice et al. | |
| 7,500,923 | B2 | * | 3/2009 | Tateno | 473/329 |
| 7,563,175 | B2 | | 7/2009 | Nishitani et al. | |
| 7,566,276 | B2 | | 7/2009 | Billings | |
| 7,594,862 | B2 | * | 9/2009 | Gilbert | 473/330 |
| 7,601,076 | B2 | * | 10/2009 | Rollinson | 473/288 |
| 7,682,262 | B2 | * | 3/2010 | Soracco et al. | 473/329 |
| 7,717,801 | B2 | * | 5/2010 | Franklin et al. | 473/251 |
| 7,749,105 | B2 | * | 7/2010 | Zielke et al. | 473/350 |
| 7,794,333 | B2 | * | 9/2010 | Wallans et al. | 473/331 |
| 7,824,278 | B2 | * | 11/2010 | Miyamichi | 473/329 |
| 2003/0017885 | A1 | | 1/2003 | Heene et al. | |
| 2003/0153399 | A1 | * | 8/2003 | Woodward et al. | 473/331 |
| 2004/0014717 | A1 | * | 1/2004 | Adachi et al. | 514/54 |
| 2004/0038746 | A1 | | 2/2004 | Wahl et al. | |
| 2004/0038747 | A1 | * | 2/2004 | Lindsay | 473/340 |
| 2005/0009623 | A1 | | 1/2005 | Dickinson | |
| 2005/0043111 | A1 | | 2/2005 | Albert et al. | |
| 2007/0191138 | A1 | | 8/2007 | Cameron | |
| 2007/0238550 | A1 | | 10/2007 | Tateno | |
| 2007/0243949 | A1 | | 10/2007 | Solari | |
| 2008/0045352 | A1 | | 2/2008 | Frame | |
| 2008/0064524 | A1 | | 3/2008 | Bryant et al. | |
| 2008/0071006 | A1 | * | 3/2008 | Emmrich et al. | 523/167 |
| 2008/0071041 | A1 | * | 3/2008 | Emmrich et al. | 525/460 |
| 2008/0108452 | A1 | | 5/2008 | Chiang | |
| 2008/0146371 | A1 | | 6/2008 | Wahl et al. | |
| 2008/0200282 | A1 | | 8/2008 | Frame et al. | |
| 2009/0029800 | A1 | | 1/2009 | Jones et al. | |
| 2010/0113184 | A1 | | 5/2010 | Kuan et al. | |

FOREIGN PATENT DOCUMENTS

| | | | | |
|---|---|---|---|---|
| JP | A-53-029459 | | | 3/1978 |
| JP | U-59-159464 | | | 10/1984 |
| JP | U-59-161854 | | | 10/1984 |
| JP | U-59-161855 | | | 10/1984 |
| JP | U-61-142075 | | | 9/1986 |
| JP | U-01-130365 | | | 9/1989 |
| JP | U-02-032865 | | | 3/1990 |
| JP | 02180282 | A | * | 7/1990 |
| JP | 08196669 | A | * | 8/1996 |
| JP | A-08-196666 | | | 8/1996 |
| JP | A-08-257180 | | | 10/1996 |
| JP | A-2000-93566 | | | 4/2000 |
| JP | A-2005-103162 | | | 4/2005 |
| WO | WO 8902769 | | * | 4/1989 |

OTHER PUBLICATIONS

Feb. 3, 2011 Office Action issued in U.S. Appl. No. 12/265,478.

* cited by examiner

PUTTER-TYPE GOLF CLUB HEAD

This is a Continuation-In-Part application of U.S. patent application Ser. No. 12/265,478 filed on Nov. 5, 2008, by Jimmy H. Kuan et al., entitled "A PUTTER-TYPE GOLF CLUB HEAD." U.S. patent application Ser. No. 12/265,478 is herein incorporated by reference in its entirety.

COPYRIGHT AUTHORIZATION

The disclosure below may be subject to copyright protection. The copyright owner has no objection to the facsimile reproduction by anyone of the documents containing this disclosure, as they appear in the Patent and Trademark Office records, but otherwise reserves all applicable copyrights.

BACKGROUND

An important performance component of a putter-type golf club is its dynamic-excitation response, i.e., the sensation or "feel", that the golf club delivers to the player at ball impact. Putter-type golf club heads typically include rigid metallic striking faces, often associated with harsh feel on off-center shots. To diminish unwanted vibration, elastic inserts may be used in the putter face. However, such inserts often provide insufficient tactile and acoustic feedback, imparting the putter with a "dead" feel that prevents the player from distinguishing a well-struck shot from a mediocre one.

SUMMARY

The present invention, in one or more aspects thereof, may advantageously comprise a putter-type golf club head having improved forgiveness on mishit shots as well as enhanced tactile and acoustic feedback.

In one example, a putter-type golf club head according to one or more aspects of the present invention may comprise a body having a front surface with an opening therein. A primary insert may be at least partially disposed in the opening and may include one or more secondary inserts having a trailing surface that is physically exposed to the elements and a leading surface that is visually exposed to the eye, but not physically exposed to the elements.

In another example, a putter-type golf club head according to one or more aspects of the present invention may comprise a body having a front surface with an opening therein. A primary insert may be at least partially disposed in the opening and may include one or more secondary inserts having a leading surface that is physically exposed to the elements and a trailing surface that is physically exposed to the elements.

In yet another example, a putter-type golf club head according to one or more aspects of the present invention may comprise a body having a front surface with an opening therein. A primary insert may be at least partially disposed in the opening and may include one or more secondary inserts having a leading surface that is physically exposed to the elements and at least one curvilinear surface that is at least partially visually exposed to the eye, but not physically exposed to the elements.

These and other features and advantages of the golf club head according to the invention in its various aspects, as demonstrated by one or more of the various examples, will become apparent after consideration of the ensuing description, the accompanying drawings, and the appended claims. The drawings described below are for illustrative purposes only and are not intended to limit the scope of the present invention.

BRIEF DESCRIPTION OF THE DRAWINGS

Exemplary implementations of the present invention will now be described with reference to the accompanying drawings, wherein.

DETAILED DESCRIPTION

Figure 1:
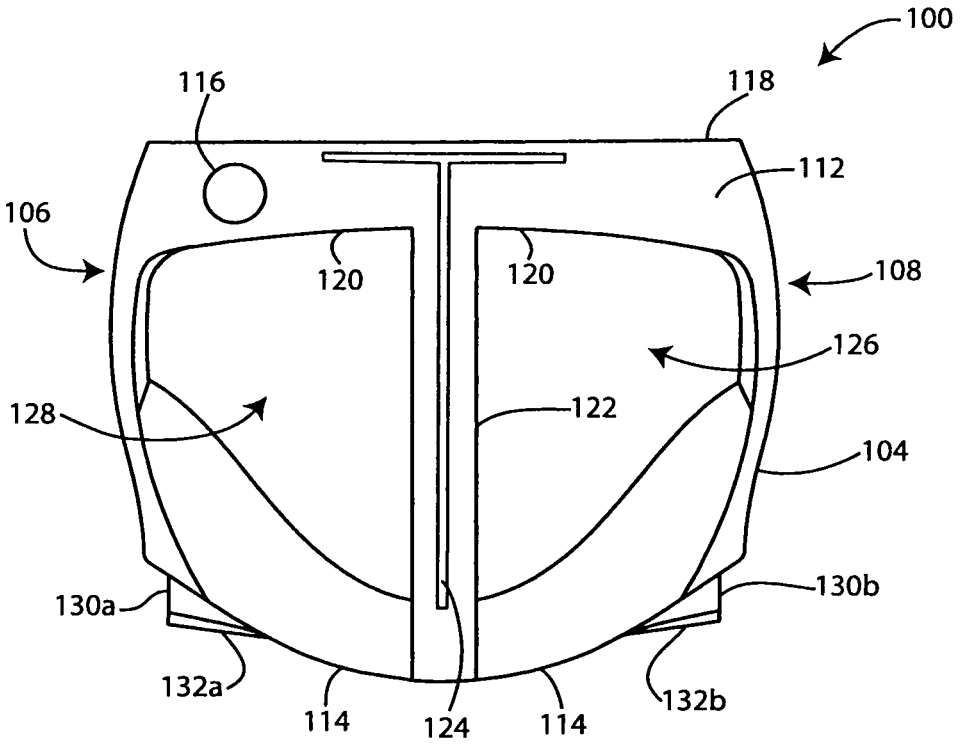
FIG. 1 is a top plan view of an exemplary golf club head in accordance with one or more aspects of the present invention.
Figure 2:
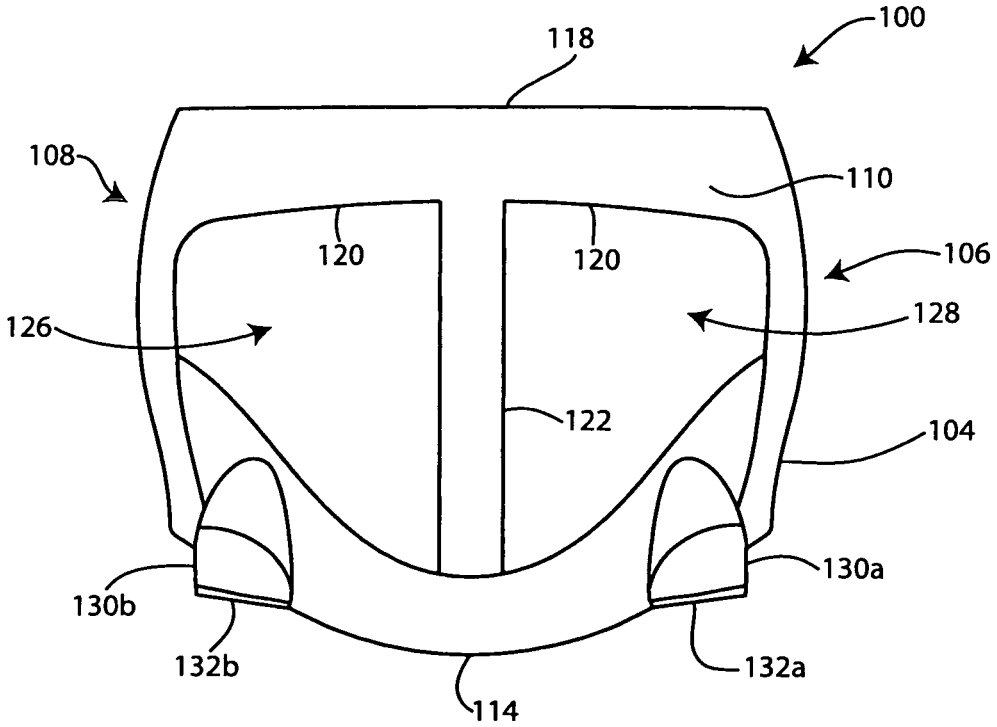
FIG. 2 is a bottom plan view of the golf club head of FIG. 1.

Referring to FIGS. 1 and 2, a putter-type golf club head 100, according to one or more aspects of the present invention, may generally comprise a body 104 formed from metallic and/or non-metallic materials, e.g., aluminum, stainless steel, titanium, composites, and/or polymeric materials. The body 104 may include a front surface 118, a rear surface 120, a toe portion 108, a heel portion 106, a sole surface 110, as well as a top surface 112 having a shaft-receiving opening 116 and an alignment feature 124. The body 104 may include a peripheral element 114. A bridge member 122, extending between the rear surface 120 and the peripheral element 114, may form at least a portion of the sole surface 110 and/or the top surface 112. A toe opening 126 may be delimited by the rear surface 120, the bridge member 122, the toe portion 108, and the peripheral element 114. A heel opening 128 may be delimited by the rear surface 120, the bridge member 122, the heel portion 106, and the peripheral element 114. A through aperture 123 (FIG. 3) may traverse the bridge member 122, connecting the toe opening 126 and the heel opening 128, to improve the inertial characteristics of the club head 100.

Figure 4:
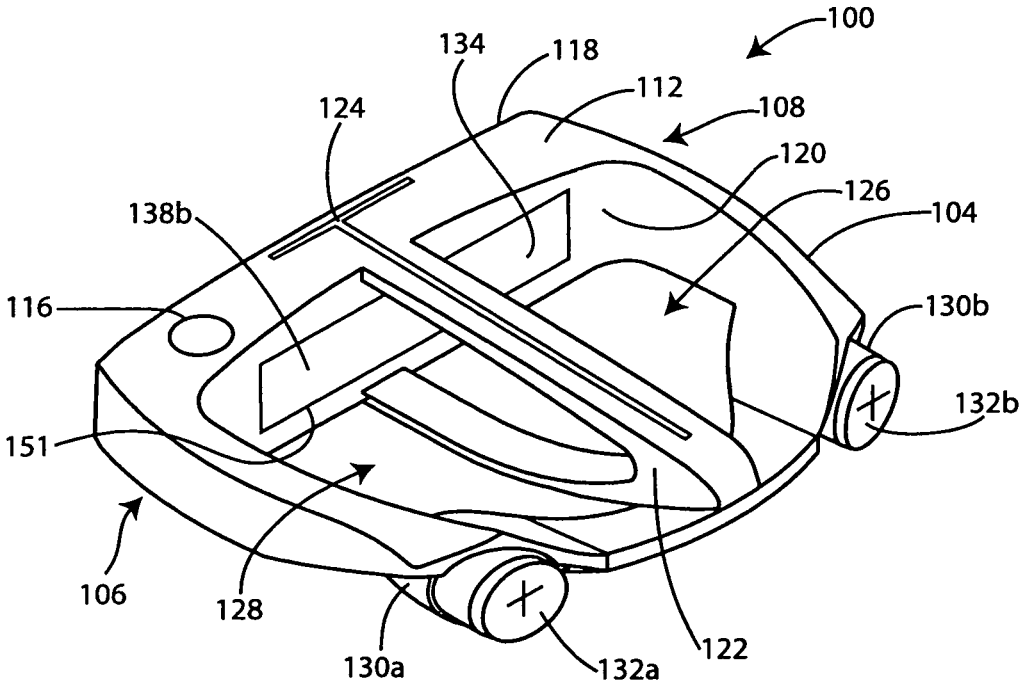
FIG. 4 is a rear perspective view of the golf club head of FIG. 1.

Referring to, e.g., FIG. 4, the peripheral element 114 may include one or more weight ports, e.g., weight ports 130*a* and 130*b*, for receiving weights, e.g., weights 132*a* and 132*b*. The weights may be permanently fixed within their respective weight ports. Alternatively, the weights may be removable and may comprise an interchangeable set including weights having different mass. For example, mass of the weight elements within the set may range from about 1 gram to about 50 grams. Typically, the weight set may include at least three elements weighing, e.g., 5 grams, 10 grams, and 15 grams, respectively. However, those skilled in the art will appreciate that the weight set may comprise any number of elements within a broad mass range. Preferably, each weight comprises a metallic material, e.g., tungsten, having a greater density than the rest of the club head 100. The weights may be strategically positioned in the club head 100 to further improve the inertial properties of the club head.

Figure 3:
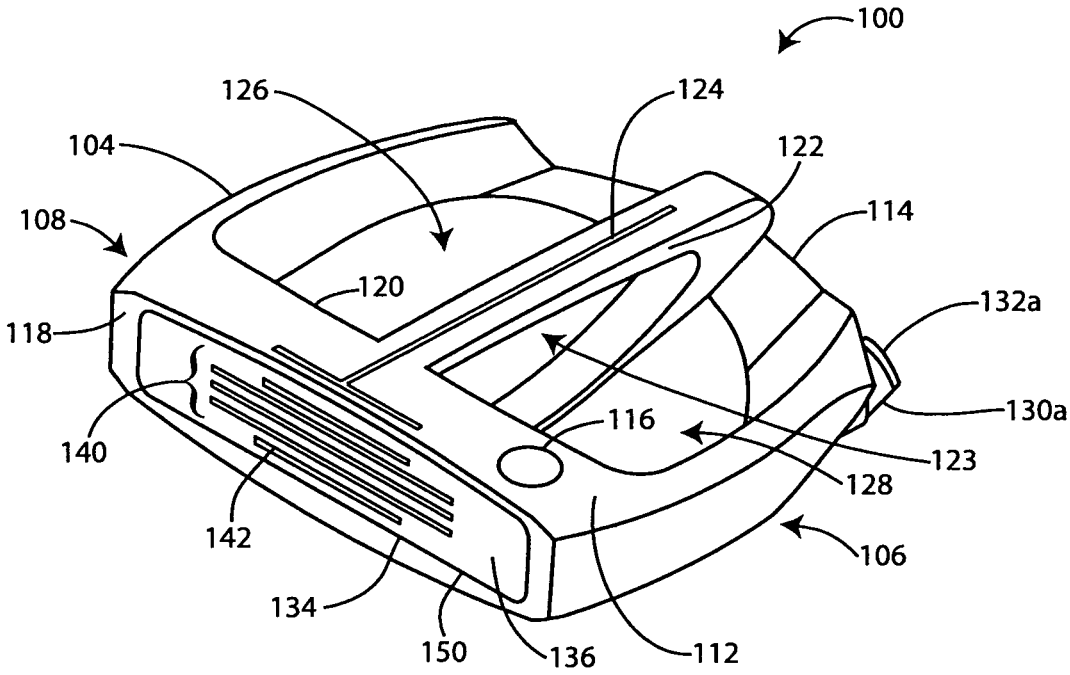
FIG. 3 is a front perspective view of the golf club head of FIG. 1.
Figure 5:
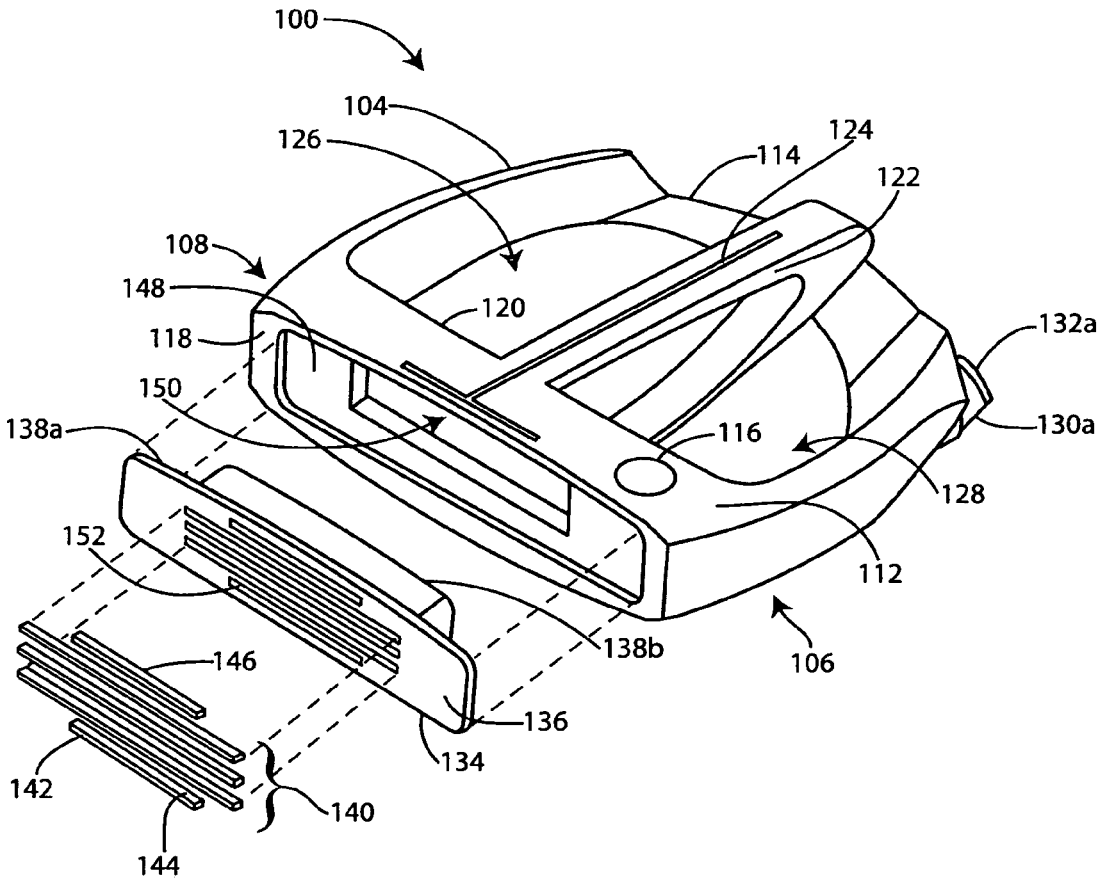
FIG. 5 is an exploded front perspective view of the golf club head of FIG. 1.
Figure 6:
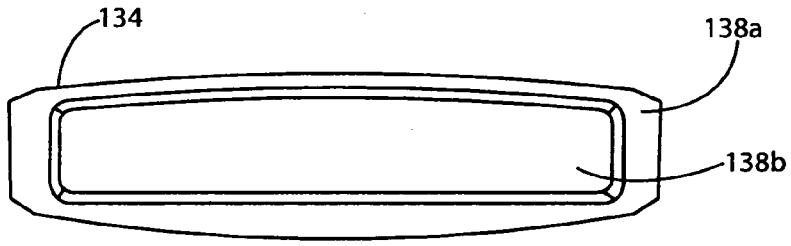
FIG. 6 is a rear elevational view of an exemplary insert in accordance with one or more aspects of the present invention.
Figure 7:
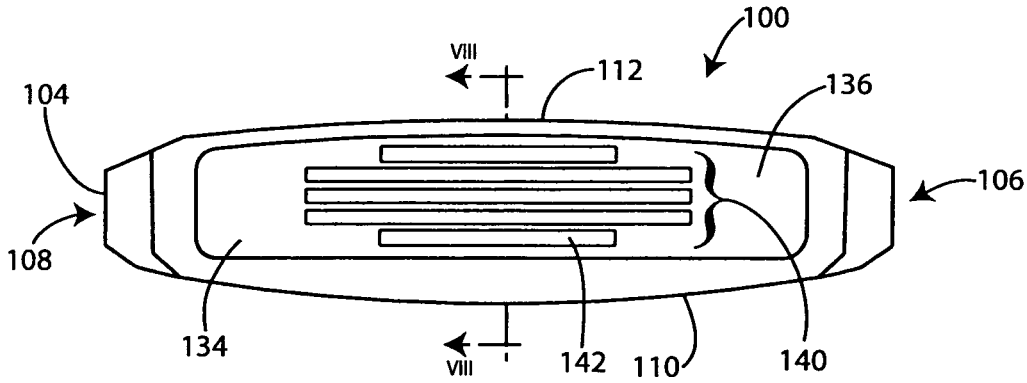
FIG. 7 is a front elevational view of the golf club head of FIG. 1.

As shown, e.g., in FIGS. 3-5, the front surface 118 may have an opening 150 for receiving a primary insert 134. The opening 150 may be a blind cavity, or alternatively, may be a through bore that penetrates the rear surface 120 to form a rear window 151, as illustrated in FIG. 4. A flange 148 (FIG. 5) may surround the rear window to support the primary insert 134. Referring to FIGS. 5 and 6, the primary insert 134 may include an anterior surface 136, a first posterior surface 138*a*, and a second posterior surface 138*b*. Preferably, the anterior surface 136 of the primary insert 134 is flush with the front surface 118 and is at least partially physically exposed to the elements. At least a part of the second posterior surface 138*b* may be flush with the rear surface 120 and may be at least partially physically exposed to the elements via the rear window 151. Indicia, e.g., such as a logo, may be printed directly on the second posterior surface 138*b*. Alternatively, the second posterior surface 138*b* may be embossed with such indicia. The first posterior surface 138*a* may be located proximate the support surface 148 and is at least in part concealed from the elements.

The primary insert 134, according to one or more aspects of the present invention, may be made from materials having a Shore hardness between about 55 D to about 115 D, or preferably between about 65 D to about 100 D, to deliver beneficial damping characteristics. Examples of materials suitable for fabricating the primary insert 134 may include polyurethane, silicone, Nylon, polypropylene (PP), polyethylene (PE), thermoplastic rubber (TPR), thermoplastic vulcanizate (TPV), thermoplastic polyurethane (TPU), thermoplastic elastomers (TPE), and natural rubber. The primary insert 134 may be bonded to the head 100 using, e.g., an epoxy-type adhesive.

Referring, e.g., to FIG. 5, the primary insert 134 may further include one or more secondary inserts 140. Preferably, the secondary inserts 140 are formed from a material having a greater durometer hardness than the primary insert 134. The dual insert combination, according to one or more aspects of the present invention, provides improved compliance on mishits, while delivering confidence-inspiring solid feel on well-struck shots. Examples of suitable materials for fabricating the secondary inserts 140 may include ABS, polycarbonate, titanium, aluminum, and stainless steel. Cavities 152 within the primary insert 134 are provided to receive the secondary inserts 140, which may be co-molded with the primary insert or, alternatively, secured within the cavities 152 by, e.g., adhesive bonding and/or mechanical interlocking.

Figure 8:
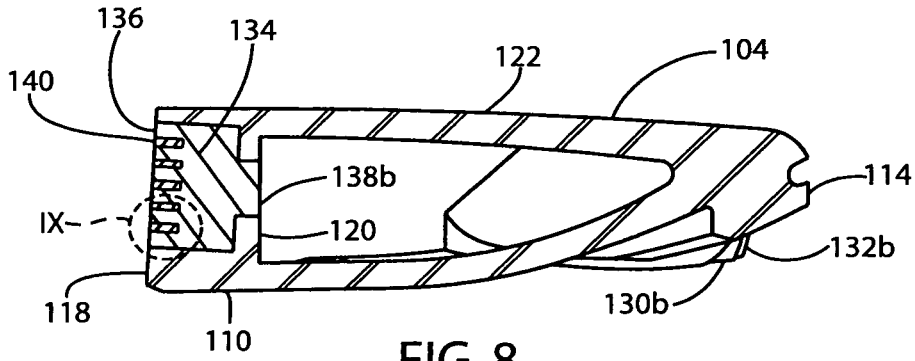
FIG. 8 is a cross-sectional view taken along the lines VIII-VIII of FIG. 7.
Figure 9:
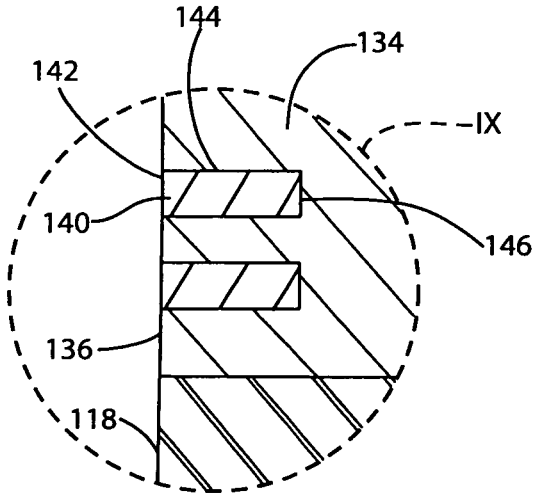
FIG. 9 is an enlarged cross-sectional view of a detail IX of FIG. 8.

Referring again to FIG. 5, each secondary insert 140 may comprise a leading surface 142, a trailing surface 146, and intermediate surfaces 144. Preferably, the surface roughness of the intermediate surfaces 144 is greater than the surface roughness of the leading surface 142 to improve retention of the secondary inserts 140 within the primary insert 134. As shown in FIGS. 8-9, the leading surfaces 142 of the secondary inserts 140 may be flush with the anterior surface 136 of the primary insert 134, such that the leading surfaces 142 are physically exposed to the elements.

Figure 9A:
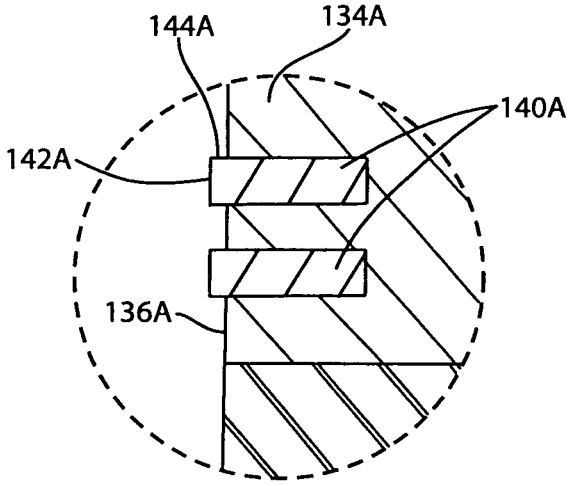
FIG. 9A is an enlarged cross-sectional view of a detail of a golf club head according to one or more aspects of the present invention.

In another example, shown in FIG. 9A, a primary insert 134A, having an anterior surface 136A, may include one or more secondary inserts 140A having a leading surface 142A and intermediate surfaces 144A disposed partially forward of the anterior surface 136A.

Figure 9B:
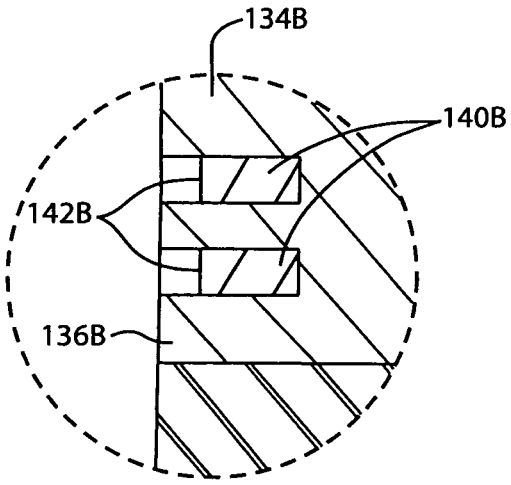
FIG. 9B is an enlarged cross-sectional view of a detail of a golf club head according to one or more aspects of the present invention.

Thus, the leading surface 142A and portions of the intermediate surfaces 144A are physically exposed to the elements. Alternatively, a primary insert 134B (FIG. 9B), having an anterior surface 136B, may include one or more secondary inserts 140B having a leading surface 142B, disposed behind the anterior surface 136B. Thus, only the leading surfaces 142B of the secondary inserts are physically exposed to the elements.

Figure 9C:
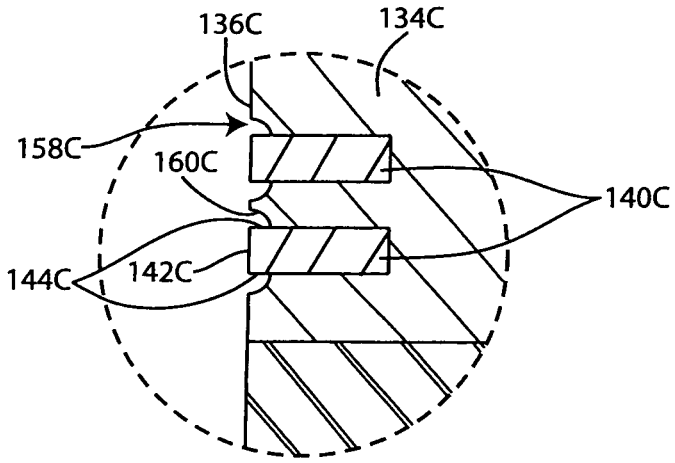
FIG. 9C is an enlarged cross-sectional view of a detail of a golf club head according to one or more aspects of the present invention.
Figure 9D:
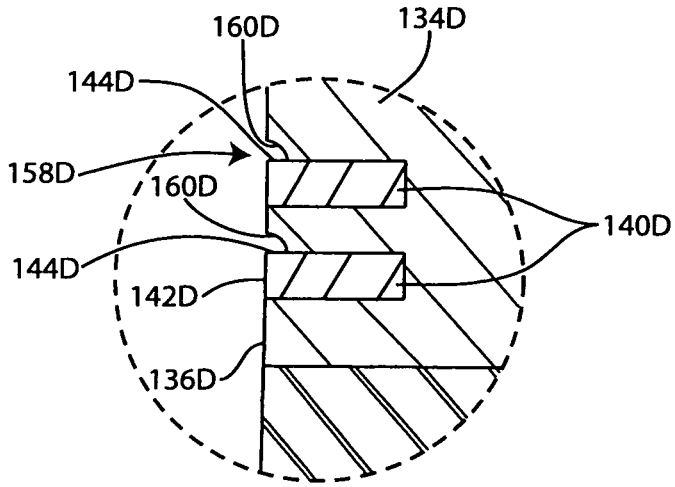
FIG. 9D is an enlarged cross-sectional view of a detail of a golf club head according to one or more aspects of the present invention.

Referring to FIG. 9C, a primary insert 134C, having an anterior surface 136C, may include one or more secondary inserts 140C having a leading surface 142C and intermediate surfaces 144C. Reveals 158C may surround portions of the secondary inserts 140C and may include continuous arcuate surfaces 160C. The reveals 158C physically expose the intermediate surfaces 144C to the elements. Alternatively, a primary insert 134D (FIG. 9D), having an anterior surface 136D, may include one or more reveals 158D having finite arcuate surfaces 160D proximate one or more secondary inserts 140D including a leading surface 142D and intermediate surfaces 144D. Thus, each reveal 158D physically exposes the corresponding intermediate surface 144D to the elements.

Figure 10A:
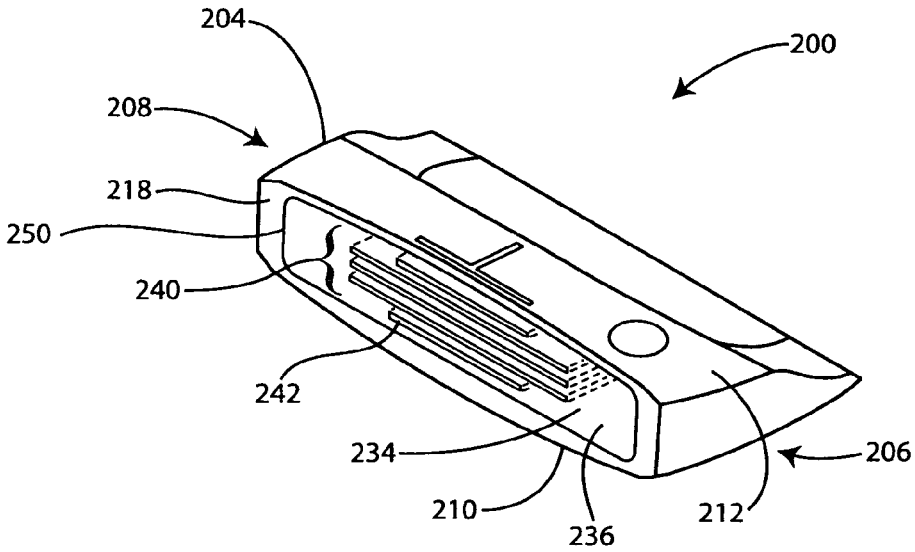
FIG. 10A is a front perspective view of an exemplary golf club head according to one or more aspects of the present invention.
Figure 10B:
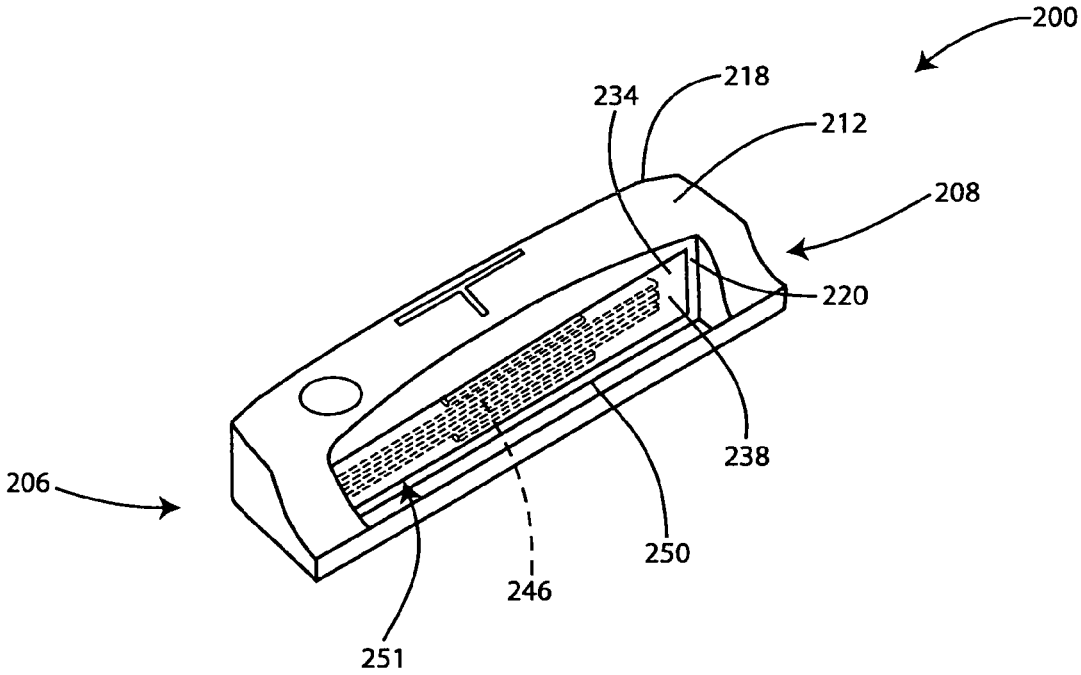
FIG. 10B is a rear perspective view of the golf club head of FIG. 10A.
Figure 10C:
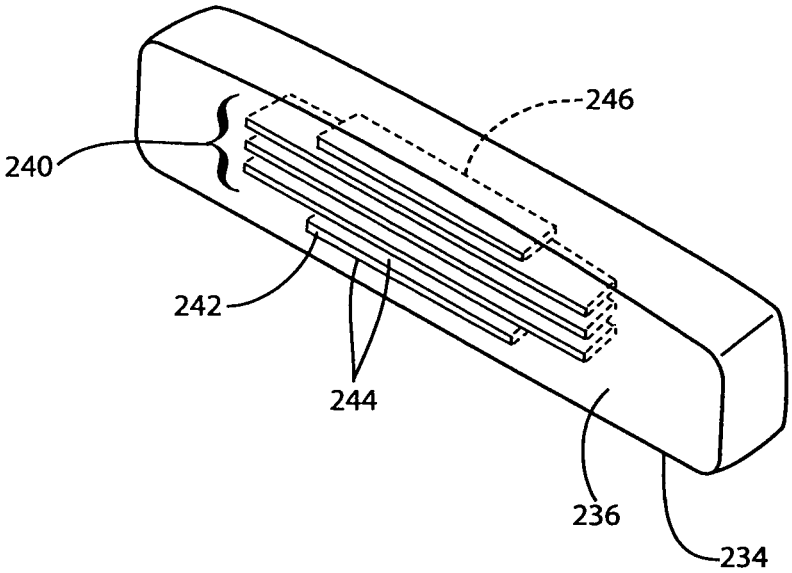
FIG. 10C is a front perspective view of an exemplary insert according to one or more aspects of the present invention.
Figure 11:
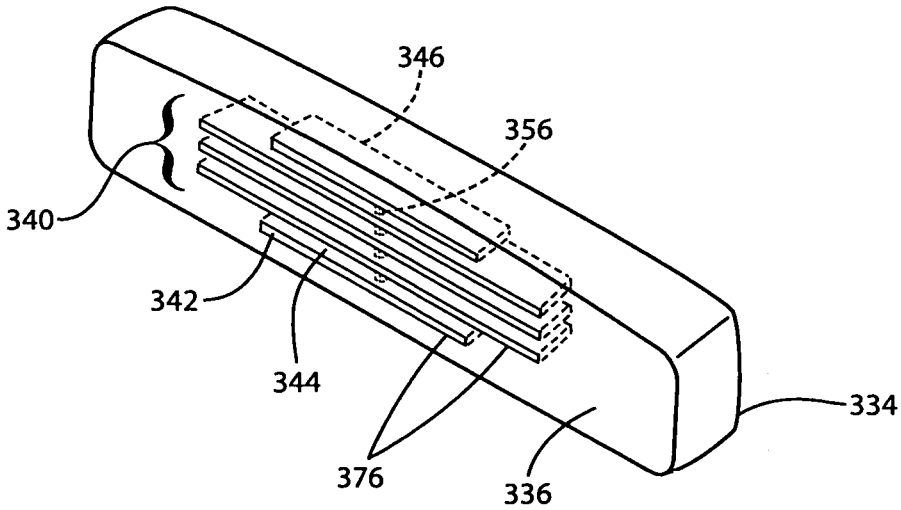
FIG. 11 is a front perspective view of an exemplary insert according to one or more aspects of the present invention.

Referring to FIGS. 10A-10C, a golf club head 200, according to one or more aspects of the present invention, may include a front surface 218, a rear surface 220, a toe portion 208, a heel portion 206, a sole surface 210, and a top surface 212. The front surface 218 may have an opening 250 disposed therein for receiving a primary insert 234, having an anterior surface 236 and a posterior surface 238. The opening 250 may be a blind cavity, or alternatively, may be a through bore that penetrates the rear surface 220 to form a rear window 251. Preferably, the primary insert 234 is formed from a transparent or translucent material, e.g., a clear or opaque plastic or polymer, with or without pigment or colorant. One or more secondary inserts 240 may be disposed in the primary insert 234 and may include a leading surface 242, a trailing surface 246, and intermediate surfaces 244 therebetween.

The leading surfaces 242 of the secondary inserts 240 may be disposed behind the anterior surface 236 and may be physically exposed to the elements. Since the primary insert 234 is transparent or translucent, at least a portion of at least one intermediate surface 244 may be exposed to the eye via the anterior surface 236. In other words, the visually exposed intermediate surfaces 244 are visually perceivable through the anterior surface 236, but are not physically exposed to the elements. Moreover, the trailing surfaces 246 and at least a portion of at least one intermediate surface 244 may be visually exposed via the rear window 251. The visual cues provided by the transparent insert may reinforce the advertised performance benefits of the present invention according to the various aspects thereof, e.g., improved compliance on mishits and solid feel on well struck shots, thus increasing the likelihood of a consumer purchase.

As shown in FIG. 1, a primary insert 334, in accordance with one or more aspects of the invention, may include a secondary insert 340 having a plurality of discrete horizontal elements 376, interconnected via one or more coupling members 356. Each horizontal element 376 may include a leading surface 342, a trailing surface 346, and intermediate surfaces 344. In other examples, alternative shapes, sizes, and orientations may be utilized for the coupling member 356 and horizontal elements 376.

Figure 12A:
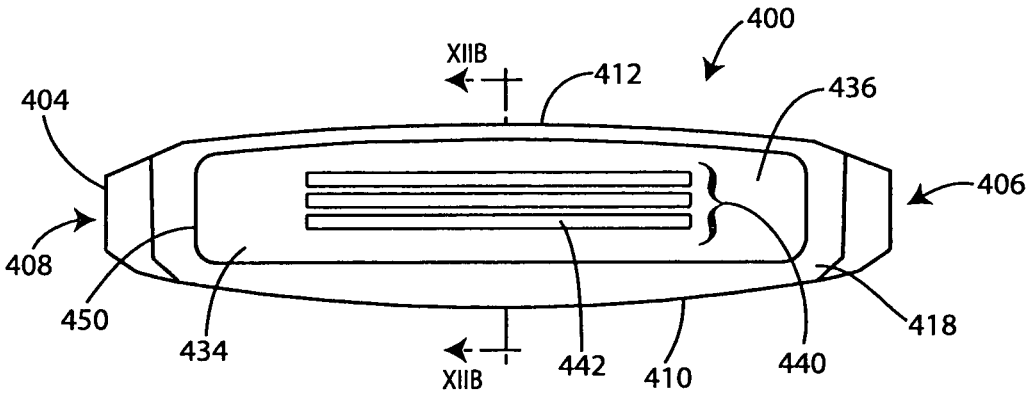
FIG. 12A is a front elevational view of an exemplary golf club head according to one or more aspects of the present invention.
Figure 12B:
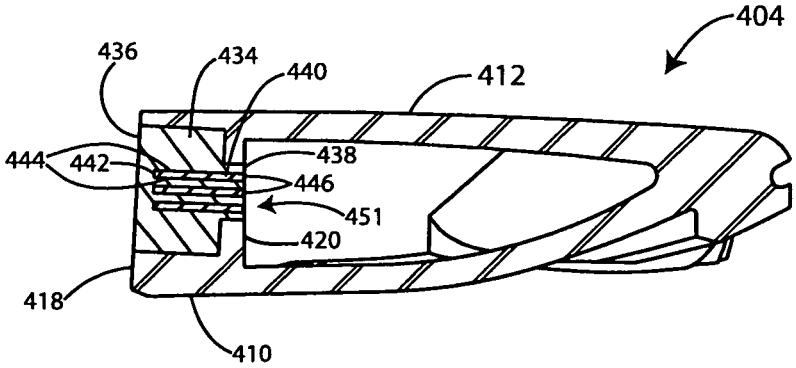
FIG. 12B is a cross-sectional view taken along the lines XIIB-XIIB of FIG. 12A.

In another example, shown in FIGS. 12A and 12B, a golf club head 400, according to one or more aspects of the present invention, may include a front surface 418, a rear surface 420, a toe portion 408, a heel portion 406, a sole surface 410, and a top surface 412. The front surface 418 may include an opening 450 for receiving a primary insert 434, having an anterior surface 436 and a posterior surface 438. Preferably, the primary insert 434 is formed from a transparent or translucent material, e.g., a clear or opaque plastic or polymer, with or without pigment or colorant. One or more secondary inserts 440 may be disposed in the primary insert 434 and may each include a leading surface 442, a trailing surface 446, and intermediate surfaces 444.

The leading surfaces 442 of the secondary inserts 440 may be disposed behind the anterior surface 436 and may be only visually exposed through the anterior surface 436 of the transparent or translucent insert 434. As illustrated in FIG. 12B, the trailing surfaces 446 may be physically exposed to the elements via a rear window 451.

Figure 13A:
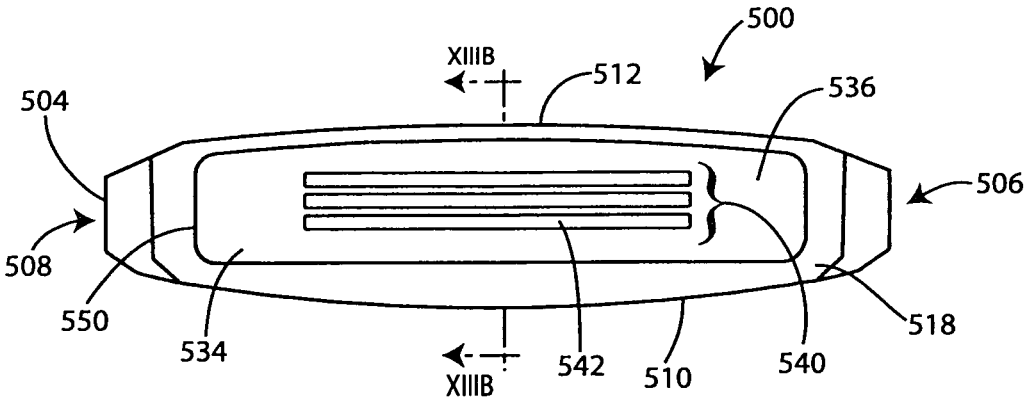
FIG. 13A is a front elevational view of an exemplary golf club head according to one or more aspects of the present invention.
Figure 13B:
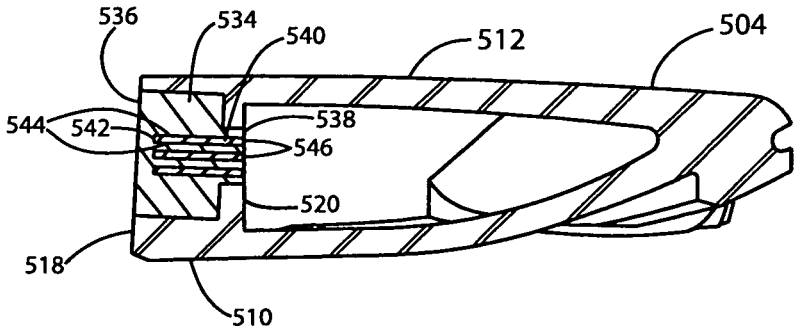
FIG. 13B is a cross-sectional view taken along the lines XIIIB-XIIIB of FIG. 13A.

In yet another example, shown in FIGS. 13A and 13B, a golf club head 500, according to one or more aspects of the present invention, may include a front surface 518, a rear surface 520, a toe portion 508, a heel portion 506, a sole surface 510, and a top surface 512. The front surface 518 may include an opening 550 for receiving a primary insert 534, having an anterior surface 536 and a posterior surface 538. One or more secondary inserts 540 may be disposed in the primary insert 534 and may each include a leading surface 542, a trailing surface 546, and intermediate surfaces 544. The leading surfaces 542 and the trailing surfaces 546 may be physically exposed to the elements. Preferably, the primary insert 534 is formed from a transparent or translucent material to visually expose at least a portion of at least one intermediate surface 544.

Figure 14A:
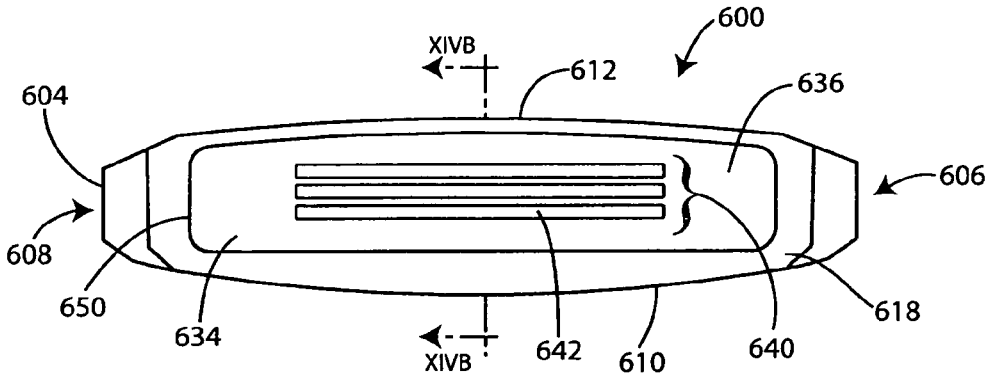
FIG. 14A is a front elevational view of an exemplary golf club head according to one or more aspects of the present invention.
Figure 14B:
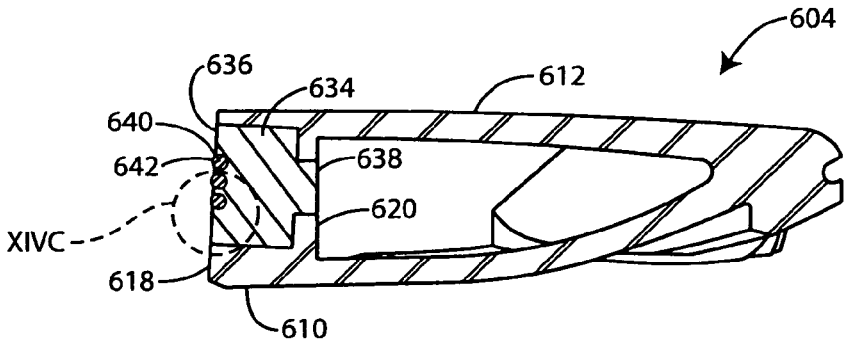
FIG. 14B is a cross-sectional view taken along the lines XIVB-XIVB of FIG. 14A.
Figure 14C:
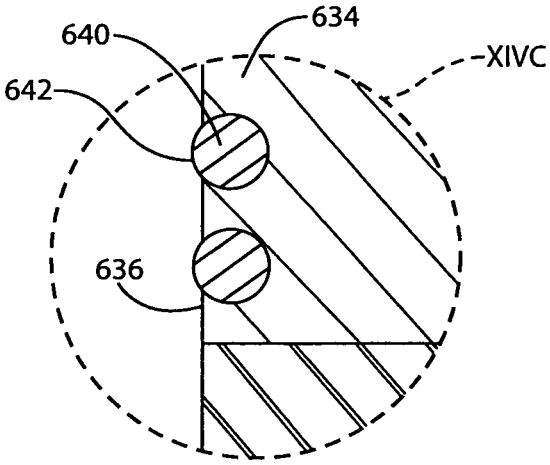
FIG. 14C is an enlarged cross-sectional view of a detail XIVC of FIG. 14B.

In yet another example, shown in FIGS. 14A-14C, a golf club head 600, according to one or more aspects of the present invention, may include a front surface 618, a rear surface 620, a toe portion 608, a heel portion 606, a sole surface 610, and a top surface 612. The front surface 618 may have an opening 650 for receiving a primary insert 634, having an anterior surface 636 and a posterior surface 638. One or more secondary inserts 640 may be disposed in the primary insert 634, each including a curvilinear surface 642, disposed partially forward of the anterior surface 636 and is partially physically exposed to the elements. Preferably, the primary insert 634 is formed from a transparent or translucent material, so that the curvilinear surface 642 is visually exposed through the posterior surface 638 and/or the anterior surface 636.

Figure 14D:
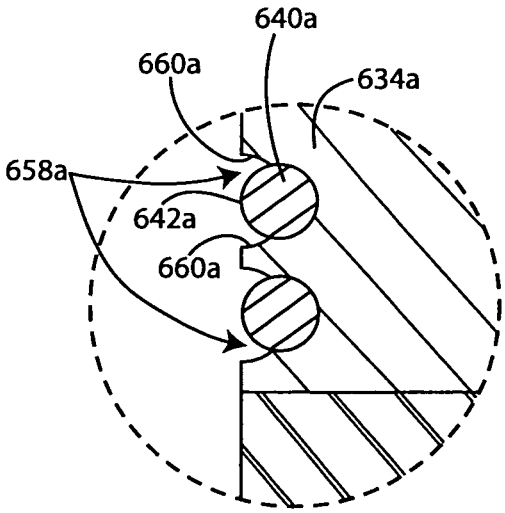
FIG. 14D is an enlarged cross-sectional view of a detail of a golf club head according to one or more aspects of the present invention.

As illustrated in FIG. 14D, a primary insert 634*a*, having an anterior surface 636*a*, may include one or more secondary inserts, each having a curvilinear surface 642*a*. The furthest forwardly projecting point of the curvilinear surface 642*a* may be substantially coplanar or flush with the anterior surface 636*a*. Reveals 658*a* may surround portions of the secondary inserts 640*a* and may include continuous beveled surfaces 660*a*. The reveals 658*a* physically expose a portion of the curvilinear surface 642*a* to the elements.

Figure 15A:
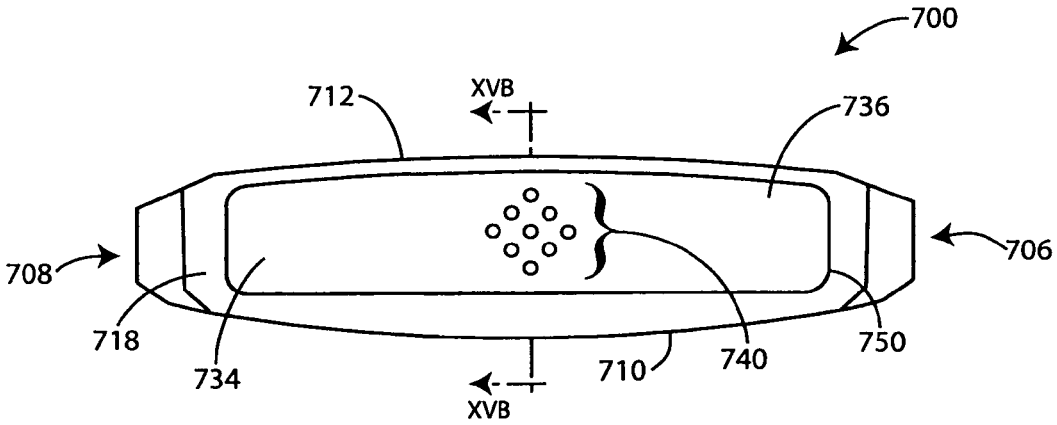
FIG. 15A is a front elevational view of an exemplary golf club head according to one or more aspects of the present invention.
Figure 15B:
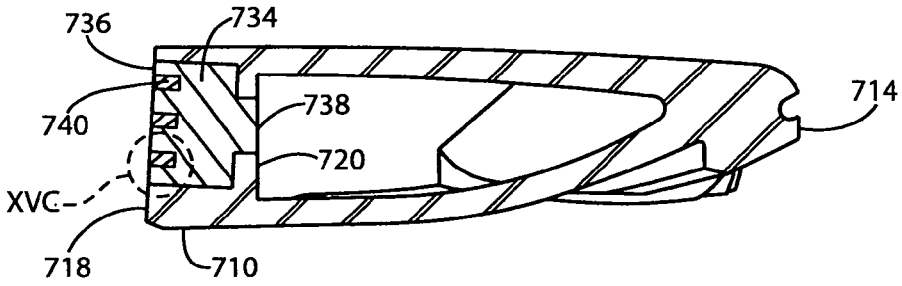
FIG. 15B is a cross-sectional view taken along the lines XVB-XVB of FIG. 15A.
Figure 15C:
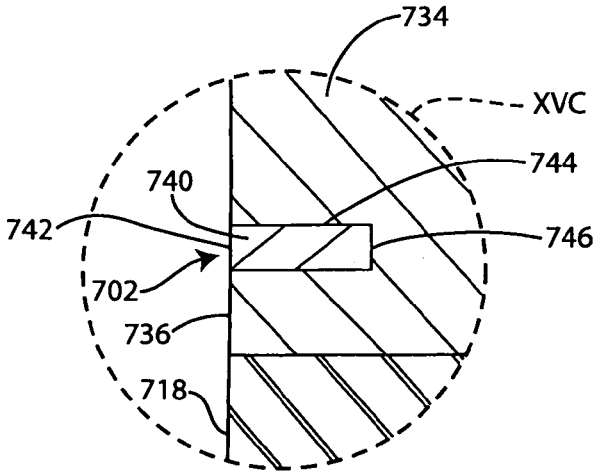
FIG. 15C is an enlarged cross-sectional view of a detail XVC of FIG. 15B.

In another example, shown in FIGS. 15A-15C, a golf club head 700, according to one or more aspects of the present invention, may include a front surface 718, a rear surface 720, a toe portion 708, a heel portion 706, a sole surface 710, and a top surface 712. The front surface 718 may have an opening 750 for receiving a primary insert 734, having an anterior surface 736 and a posterior surface 738. One or more secondary inserts 740 may be disposed in the primary insert 734 and may include a leading surface 742, a trailing surface 746, and a curvilinear surface 744. The leading surfaces 742 may be substantially coplanar or flush with the anterior surface 736 and may be physically exposed to the elements. Preferably, the primary insert 734 is formed from a translucent or transparent material, so that the trailing surfaces 746 and the curvilinear surfaces 744 are visually exposed to the eye.

In the foregoing specification, the invention has been described with reference to specific exemplary aspects thereof. It will, however, be evident that various modifications and changes may be made thereto without departing from the broader spirit and scope of the invention as set forth in the appended claims. The specification and drawings are, accordingly, to be regarded in an illustrative rather than a restrictive sense.

What is claimed is:

1. A putter head comprising:

a body formed from a metallic material having a planar front surface, a rear surface, a heel portion and a toe portion opposite the heel portion;

an opening in the front surface extending into the body toward the rear surface;

a primary insert disposed within the opening and having a generally planar anterior surface and a plurality of cavities extending from the anterior surface towards the rear surface, the cavities being elongated in the heel to toe direction;

a secondary insert comprising a plurality of horizontal elements, each of the plurality of cavities receiving one of the plurality of horizontal elements, each horizontal element having a curvilinear physically-exposed surface; and a plurality of reveals extending into the anterior surface of the primary insert, each reveal being adjacent one of the horizontal elements;

wherein the secondary insert further comprises a forwardmost projecting point that is coplanar with the anterior surface of the primary insert.

2. The putter head of claim 1, wherein the anterior surface of the primary insert is coplanar with the front surface of the body.

3. The putter head of claim 1, wherein the primary insert has a first hardness and the secondary insert has a second hardness, the second hardness being greater than the first hardness.

4. The putter head of claim 1, wherein the hardness of the primary insert is between about Shore 55 D and Shore 115 D.

5. The putter head of claim 4, wherein the hardness of the primary insert is between about Shore 65 D and Shore 100 D.

6. The putter head of claim 1, wherein the primary insert is made from a polymeric material.

7. The putter head of claim 1, wherein the primary and secondary inserts are co-molded.

8. The putter head of claim 1, wherein the primary and secondary inserts are mechanically interlocked.

9. The putter head of claim 1, wherein the secondary insert is adhesively bonded to the primary insert.

10. The putter head of claim 1, wherein the opening is a blind cavity.

11. The putter head of claim 1, wherein the opening penetrates the rear surface of the body.

12. The putter head of claim 1, wherein the primary insert is made from a non-metallic material and the secondary insert is made from a metallic material.

13. The putter head of claim 12, wherein the secondary insert is made from a material selected from the group consisting of titanium, aluminum, and stainless steel.

14. The putter head of claim 1, wherein each horizontal element has a forwardly convex curvilinear physically-exposed surface.

15. A putter head comprising:

a body formed from a metallic material having a planar front surface, a rear surface, a heel portion and a toe portion opposite the heel portion;

an opening in the front surface extending into the body toward the rear surface;

a primary insert disposed within the opening and having a generally planar anterior surface and a plurality of cavities extending from the anterior surface towards the rear surface, the cavities being elongated in the heel to toe direction;

a secondary insert comprising a plurality of horizontal elements, each of the plurality of cavities receiving one of the plurality of horizontal elements, each horizontal element having a curvilinear physically-exposed surface; and a plurality of reveals extending into the anterior surface of the primary insert, each reveal being adjacent one of the horizontal elements.

16. The putter head of claim 15, wherein each horizontal element has a forwardly convex curvilinear physically-exposed surface.

* * * * *